US005353813A

United States Patent [19]

Deevi et al.

[11] Patent Number: 5,353,813

[45] Date of Patent: Oct. 11, 1994

[54] REINFORCED CARBON HEATER WITH DISCRETE HEATING ZONES

[75] Inventors: Seetharama C. Deevi; Grier S. Fleischhauer, both of Midlothian; Billy J. Keen, Jr., Chesterfield, all of Va.

[73] Assignee: Philip Morris Incorporated, New York, N.Y.

[21] Appl. No.: 931,997

[22] Filed: Aug. 19, 1992

[51] Int. Cl.[5] ..... A24F 47/00

[52] U.S. Cl. ..... 131/194; 131/329; 131/273

[58] Field of Search ..... 131/194, 195, 270, 271, 131/273, 329; 219/240, 543, 254; 392/386, 403, 404; 128/203.17, 203.27; 338/306–310, 225, 226, 332, 294

[56] References Cited

U.S. PATENT DOCUMENTS

| | | | |
|---|---|---|---|
| 1,771,366 | 7/1930 | Wyss et al. . | |
| 2,971,039 | 2/1961 | Westeren . | |
| 2,997,451 | 8/1961 | Miller . | |
| 3,057,936 | 10/1962 | Hill . | |
| 3,178,665 | 4/1965 | Matheson et al. . | |
| 3,200,819 | 8/1965 | Gilbert | 128/200 |
| 3,420,985 | 1/1969 | Anderson et al. . | |
| 3,444,183 | 5/1969 | Hubbuch | 260/32.6 |
| 3,521,643 | 2/1968 | Toth | 128/261 |
| 3,563,916 | 2/1971 | Takashina et al. | 252/511 |
| 3,587,573 | 6/1971 | Flack | 128/201 |
| 3,726,984 | 4/1973 | Anthony et al. . | |
| 4,215,708 | 8/1980 | Bron | 131/262 B |
| 4,503,319 | 3/1985 | Moritoki et al. . | |
| 4,609,972 | 9/1986 | Edeling et al. | 361/433 |
| 4,686,353 | 8/1987 | Spector . | |
| 4,775,655 | 10/1988 | Edwards et al. | 502/416 |
| 4,799,957 | 1/1989 | Vogel | 75/243 |
| 4,822,538 | 4/1989 | Yoshida et al. | 264/29.4 |
| 4,847,021 | 7/1989 | Montgomery et al. | 264/29.3 |
| 4,849,251 | 7/1989 | Tanaka | 427/101 |
| 4,877,554 | 10/1989 | Honma et al. | 252/511 |
| 4,883,617 | 11/1989 | Benn et al. | 264/29.7 |
| 4,902,562 | 2/1990 | Bahia | 428/283 |
| 4,916,292 | 4/1990 | Kawakubo et al. | 219/553 |
| 4,917,923 | 4/1990 | Yoshida et al. | 428/34.1 |
| 4,919,779 | 4/1990 | Mizoguchi et al. | 204/192.3 |
| 4,921,559 | 5/1990 | Odajima | 156/242 |
| 4,950,443 | 8/1990 | Kawakubo et al. | 264/29.5 |
| 4,966,171 | 10/1990 | Serrano et al. | 131/194 |
| 4,970,189 | 11/1990 | Tachibana | 502/183 |
| 4,981,522 | 1/1991 | Nichols et al. | 131/274 |
| 4,991,606 | 2/1991 | Serrano et al. | 131/359 |
| 5,040,552 | 8/1991 | Schleich et al. | 131/359 |
| 5,060,671 | 10/1991 | Counts et al. | 131/359 |
| 5,076,296 | 12/1991 | Nystrom et al. | 131/359 |
| 5,093,894 | 3/1992 | Deevi et al. | 392/390 |
| 5,095,921 | 3/1992 | Losee et al. | 131/194 |
| 5,157,242 | 10/1992 | Hetherington et al. . | |
| 5,159,940 | 11/1992 | Hayward et al. | 131/194 |
| 5,224,498 | 7/1993 | Deevi et al. | 131/194 |
| 5,228,460 | 7/1993 | Sprinkel et al. | 128/203.27 X |

FOREIGN PATENT DOCUMENTS

| | | |
|---|---|---|
| 0295122 | 12/1988 | European Pat. Off. . |
| 60-44963 | 3/1985 | Japan . |
| 61-12918 | 1/1986 | Japan . |
| 61-32958 | 2/1986 | Japan . |
| 61-86411 | 5/1986 | Japan . |

OTHER PUBLICATIONS

Kinoshita, K., "Manufacture of Carbons for Electrochemical applications," Carbon: Electrochemical and Physicochemical Properties, pp. 10–14.

Dummer, G. W. A., Materials for Conductive and Resistive Functions (Hayden Book Company, Inc., New York 1970), chapter 12.

*Primary Examiner*—Jennifer Bahr

*Attorney, Agent, or Firm*—Charles E. B. Glenn; James E. Schardt; Kevin B. Osborne

[57] ABSTRACT

A bladed tubular array for use as a heating element in an electrical smoking article, and a tobacco flavor element for such an article based thereon, are provided. The integral carbon heater preferably provides eight thermally and electrically discrete heating zones to provide an optimized heating zone when each blade is individually powered. Each blade has a desired resistance, to provide temperature preferably in the range of from about 300° C. to about 900° C., or higher. The relatively brittle carbon composite conductive blades are supported by a reinforcing tube of spiral-wound paperboard. A common ring of the same conductive material serves as a common electrical terminal for the blades, while the free end of each blade serves as the other electrical terminal of that blade.

62 Claims, 6 Drawing Sheets

REINFORCED CARBON HEATER WITH DISCRETE HEATING ZONES

BACKGROUND OF THE INVENTION

This invention relates to electric heating elements used to heat a tobacco flavor generating medium in an electrical smoking article. In particular, this invention relates to such a heating element arranged in a tubular array.

One type of electrical smoking article is disclosed in commonly-assigned U.S. Patent No. 5,060,671 which is hereby incorporated by reference in its entirety. In such an electrical smoking article, a flavor bed of a tobacco flavor medium, such as tobacco or tobacco-derived substances, is heated electrically to release a tobacco flavor substance without burning. As the tobacco flavor medium is heated, a smoker at the mouth or downstream end of the device draws air in and around the heating element by inhaling, and thereby receives the tobacco flavor substance.

The above-identified application discloses a number of possible heater configurations, many of which are made from a carbon composite material formed into a desired shape. For example, one configuration involved a radial array of blades connected in common at the center and separately connectable at their outer edges to a source of electrical power. By depositing tobacco flavor medium on each blade and heating the blades individually, one could provide a predetermined number of discrete puffs to the smoker. Other configurations included various linear and tubular shapes, subdivided to provide a number of discrete heating areas.

Other configurations have been proposed. For example, various arrays of discrete fingers or blades of heater material can be provided, each blade providing one puff. However, suitable heater materials, such as those described in said above-incorporated U.S. Pat. No. 5,060,671 are generally not strong enough to be arranged in such a blade configuration without threat of blade breakage. This is particularly true of a preferred material made by mixing carbon, fillers and binders and curing and heating the mixture until the desired resistivity is achieved. This material has been found to have the proper electrical resistivity characteristics and evolves no undesirable constituents when heated to operating temperature.

Further, as disclosed in said above-incorporated U.S. Pat. No. 5,060,671, such heating elements are preferably disposable and replaceable. Therefore, they must be relatively inexpensive to produce.

It would be desirable to be able to provide an array of heater blades or fingers that is sufficiently strong for use in an electrical smoking article without danger of breakage.

It is also desirable to be able to provide such an array of heater blades that is sufficiently inexpensive to manufacture that it can be disposable.

SUMMARY OF THE INVENTION

It is an object of this invention to provide an array of heater blades or fingers that is sufficiently strong for use in an electrical smoking article without danger of breakage.

It is also an object of this invention to provide such an array of heater blades that is sufficiently inexpensive to manufacture that it can be disposable.

Therefore, in accordance with the present invention there is provided a heating element for an an electrical smoking article. The heating element has a mouth end and a rod end and includes a ring or hub having a central axis, and a plurality of electrically conductive blades attached to the ring and extending in one direction parallel to the central axis. Each of the blades has a free end remote from the ring. The heating element has a hollow central core circumscribed by the ring and the blades. Finally, the heating element has support means disposed within the hollow central core for supporting the blades.

A tobacco flavor element for such an electrical smoking article is also provided, incorporating the heating element and a mouthpiece tube disposed about the heating element, thereby forming a fluid flow passage between the inner wall and the blade portion circumference. The mouthpiece tube has inner and outer walls and contact means on the inner wall for electrically contacting the ring. The tobacco flavor element also includes socket means having first electrical connector means for electrically contacting the contact means on the inner wall of the mouthpiece tube, and a plurality of second electrical connector means, corresponding to the plurality of blades, for electrically contacting each of the free ends of the blades. The socket also has main connector means for connecting to a power and control module of an electrical smoking article, as well as means for providing fluid communication between external atmosphere and the fluid flow passage adjacent the rod end. A tobacco flavor medium is disposed on the blades.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
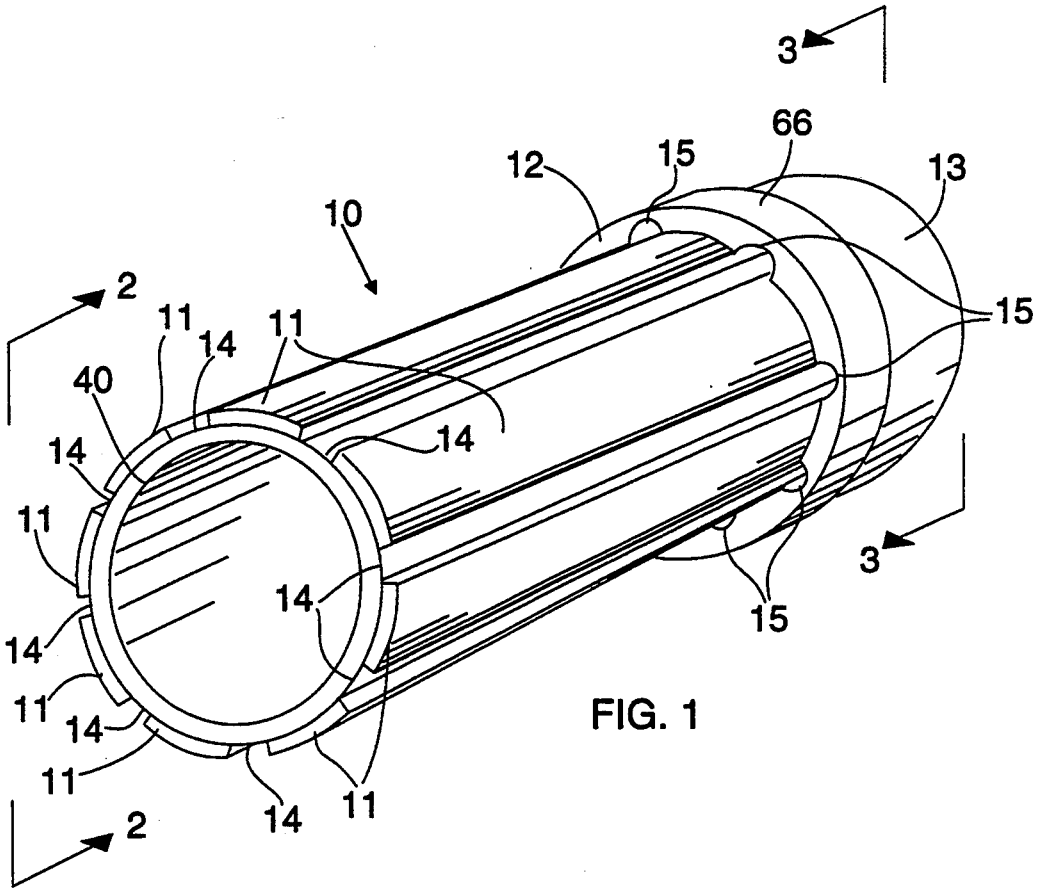
FIG. 1 is a rod end perspective view of a preferred embodiment of a heating element in accordance with the present invention.
Figure 2:
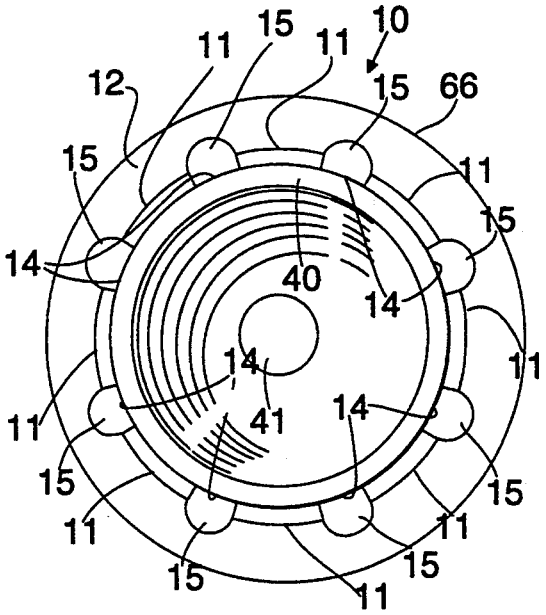
FIG. 2 is rod end elevational view of the heating element of FIG. 1 taken from line 2—2 of FIG. 1.
Figure 3:
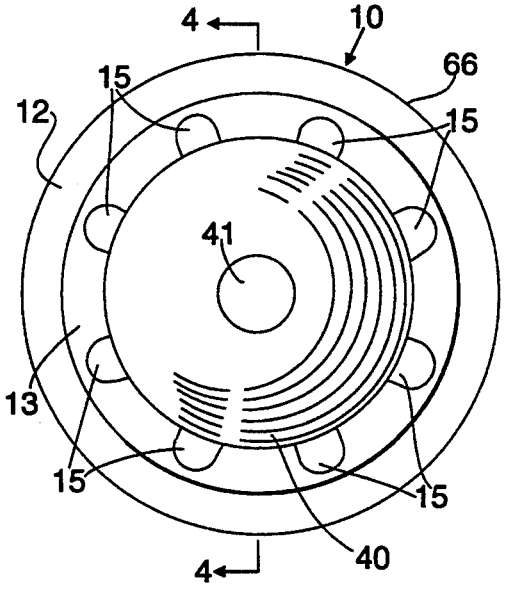
FIG. 3 is a mouth end elevational view of the heating element of FIGS. 1 and 2 taken from line 3—3 of FIG. 1.
Figure 4:
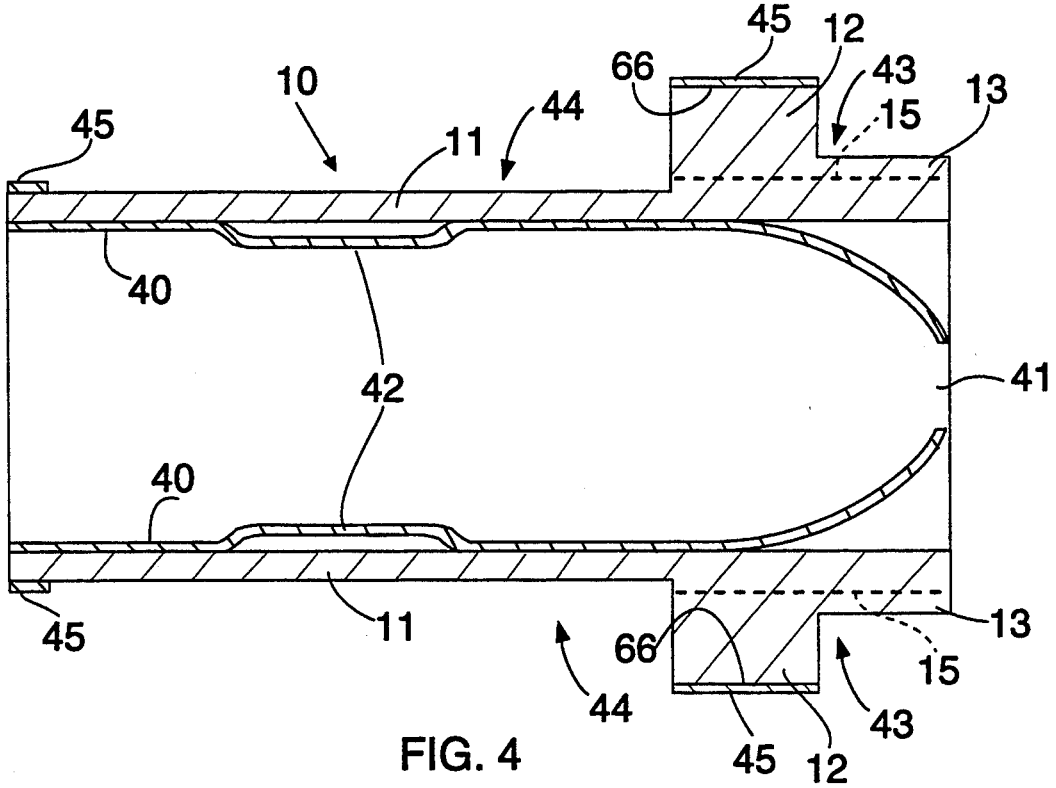
FIG. 4 is longitudinal cross-sectional view of the heating element of FIGS. 1–3, taken from line 4—4 of FIG. 3.

The heating element of the present invention is a tubularly-arranged array of finger-like heater blades connected to a common ring that serves as a common electrical terminal. The heating element is unitarily formed from an electrically conductive composition such as, preferably, the carbon composite material referred to above, with a reinforcing inner tube of paperboard or similar material. The blades all extend in one direction from the ring, parallel to the central axis of the ring, so that the overall appearance of the heating element is of a cylindrical element having a ring at one end with a number of blades extending toward the other end, where each blade end serves as its own electrical terminal. The number of blades corresponds to the number of puffs (preferably, e.g., at least about eight) it is desired to provide in an electrical smoking article into which the heating element is to be incorporated, and the portion of the circumference occupied by the blades exceeds the portion of the circumference occupied by the spaces between the blades. The ring has a greater diameter than the remainder of the heating element, and the spaces between the blades extend through the ring, for reasons which will become more apparent below.

When the heating element of the present invention is included in a tobacco flavor element, for subsequent inclusion in an electrical smoking article, its blades are coated with a tobacco flavor medium such as that disclosed in said above-incorporated U.S. Pat. No. 5,060,671.

The coated heating element is surrounded by a tube. The inner surface of the tube sits on the portion of the heating element which has the greatest diameter, which is the ring. Thus the inner surface of the tube is the preferred choice for completing the electrical connection to the outer surface of the ring. Appropriate metallic or other conductive terminals contact the inner surface of the tube, and also mechanically connect the tube to the remainder of the tobacco flavor element. Similar terminals contact the respective blade ends.

For this purpose, a conductive metallic layer is coated or laminated onto the inner surface of the tube. Similarly, a metallic layer is applied to the outer surface of the ring to reduce contact resistance between the outer surface of the ring and the inner surface of the tube. Some examples of appropriate techniques for applying the conductive metallic layers are described in G.W.A. Dummer, *Materials for Conductive and Resistive Functions* (Hayden Book Company, Inc., New York 1970), which is hereby incorporated by reference in its entirety, and particularly in Chapter Twelve thereof.

In at least one embodiment the tobacco flavor element includes a socket bearing the electrical terminals and connecting at its remote end to the power and control portion of the electrical smoking article for selective energizing of individual blades to generate tobacco flavor substance. This socket bears against the ends of the tube and the blades, and, together with the tube, the blades and the ring, define a void between the blades and the inner surface of the tube. It is into this void that the tobacco flavor substance is evolved. In order for the smoker to be able to draw on the tobacco flavor substance, passages are provided in the socket connecting the rod end of the void to the outside air. The above-mentioned extensions through the ring of the spaces between the blades connect the mouth end of the void to the outside air.

The invention will now be more particularly described in connection with its preferred embodiments, with reference to the FIGURES. A preferred embodiment of the heating element 10 of the invention is shown in FIGS. 1–4. As shown, heating element 10 is generally cylindrical, with cylindrically-arranged carbon composite blades 11 unitarily formed with carbon composite ring or collar 12 and rearward tubular carbon composite extension 13. Spaces 14 between blades 11 extend through ring 12 as passages 15.

Reinforcing tube 40 is disposed in the hollow center of heating element 10 and has an outer diameter substantially the same as the inner diameter of the carbon composite portion of heating element 10, so that reinforcing tube 40 supports blades 11 against breakage. Reinforcing tube 40 may have optional depressions 42 adjacent blades 11 for reasons to be discussed below. Reinforcing tube 40 tapers down to opening 41 at its mouth end for reasons also discussed below.

Figure 5:
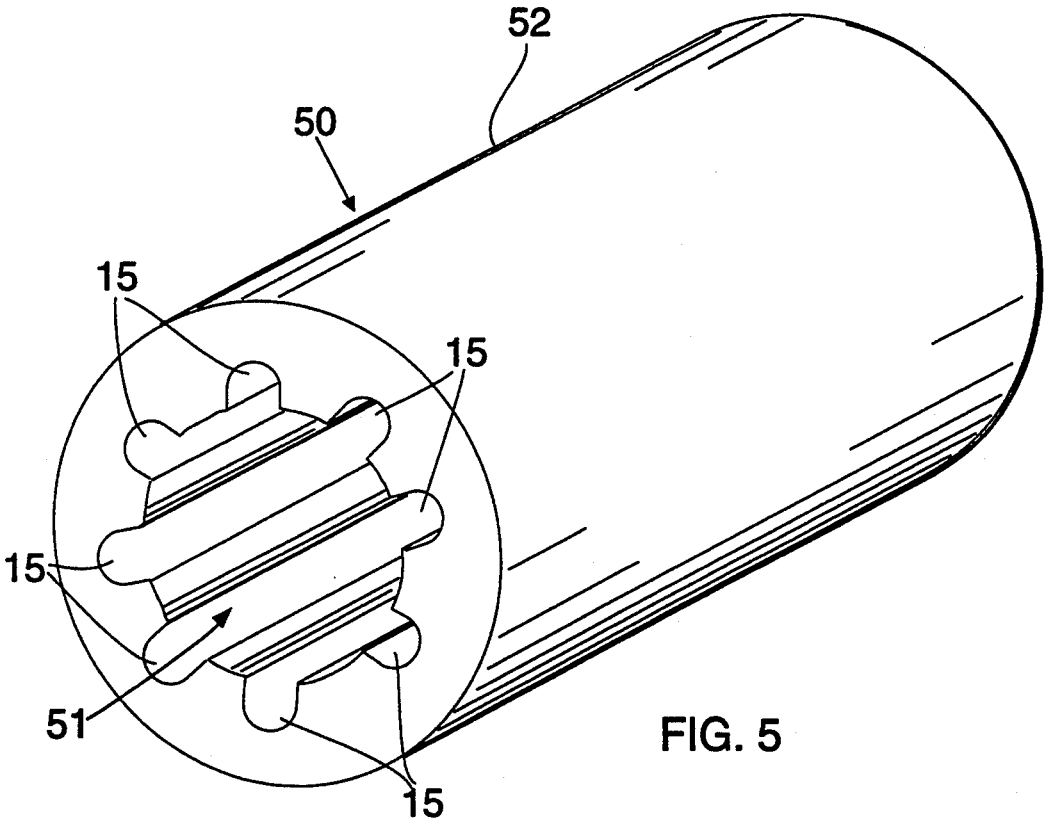
FIG. 5 is a perspective view of a precursor of the heating element of FIGS. 1–4.

Heating element 10 may be made from an integral carbon composite precursor element 50, shown in FIG. 5, which is preferably extruded or molded with central bore 51 and passages 15 already provided. The outer surface 52 of precursor element 50 corresponds in diameter to that of ring 12 in the finished heating element 10. Outer surface 52 is machined down in area 43, without penetrating passages 15, to form extension 13. Outer surface 52 is machined down further in area 44, penetrating passages 15 to form spaces 14 and individual blades 11. The methods used to form, and to machine or grind, precursor element 50 may be those described in co-pending, commonly assigned U.S. patent application Ser. No. 07/932,224, filed concurrently herewith and hereby incorporated by reference in its entirety.

Reinforcing tube 40 is preferably made of paperboard, such as hard-calendared paperboard or cardboard, which is substantially non-combustible at the temperatures at which heating element 10 is expected to operate. Tube 40 may be formed by any suitable tube forming technique, such as conventional spiral-wound tube making processes. Tube 40 can be inserted into element 50 either before or after grinding of element 50, but is preferably inserted before grinding so that it can support blades 11 during the grinding operation as well as afterwards. The tapered portion of tube 40, referred to above, assists in insertion of tube 40 into element 50, although it also serves another function as discussed below. Optionally, tube 40 may be adhered to element 50 by any suitable adhesive that can withstand the operating temperatures of heating element 10 without evolving undesirable compounds that might affect the taste of the electrical article.

Figure 6:
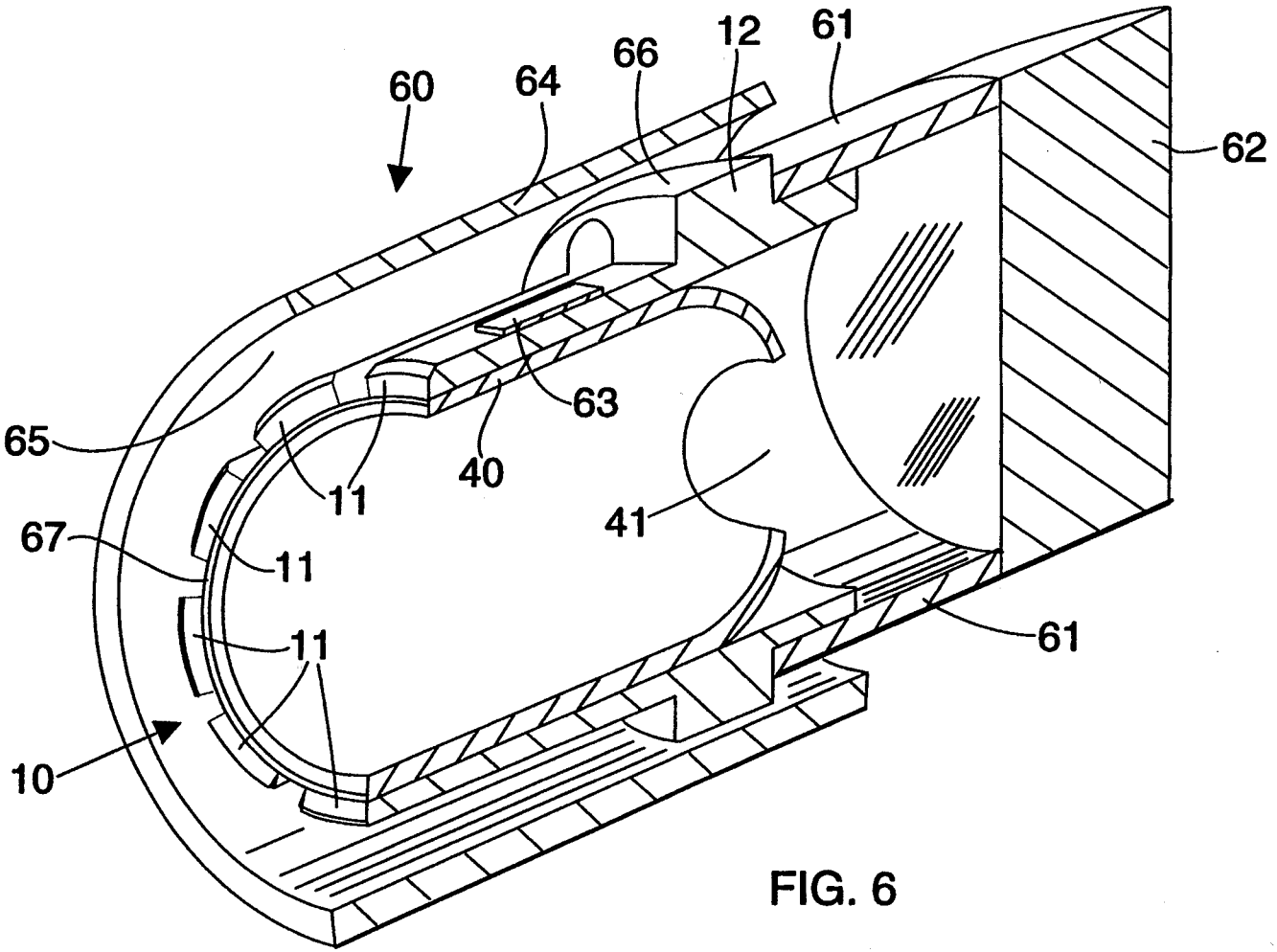
FIG. 6 is a fragmentary perspective view taken from the rod end of a first preferred embodiment of a flavor generating element according to the present invention, incorporating the heating element of FIGS. 1–5.
Figure 7:
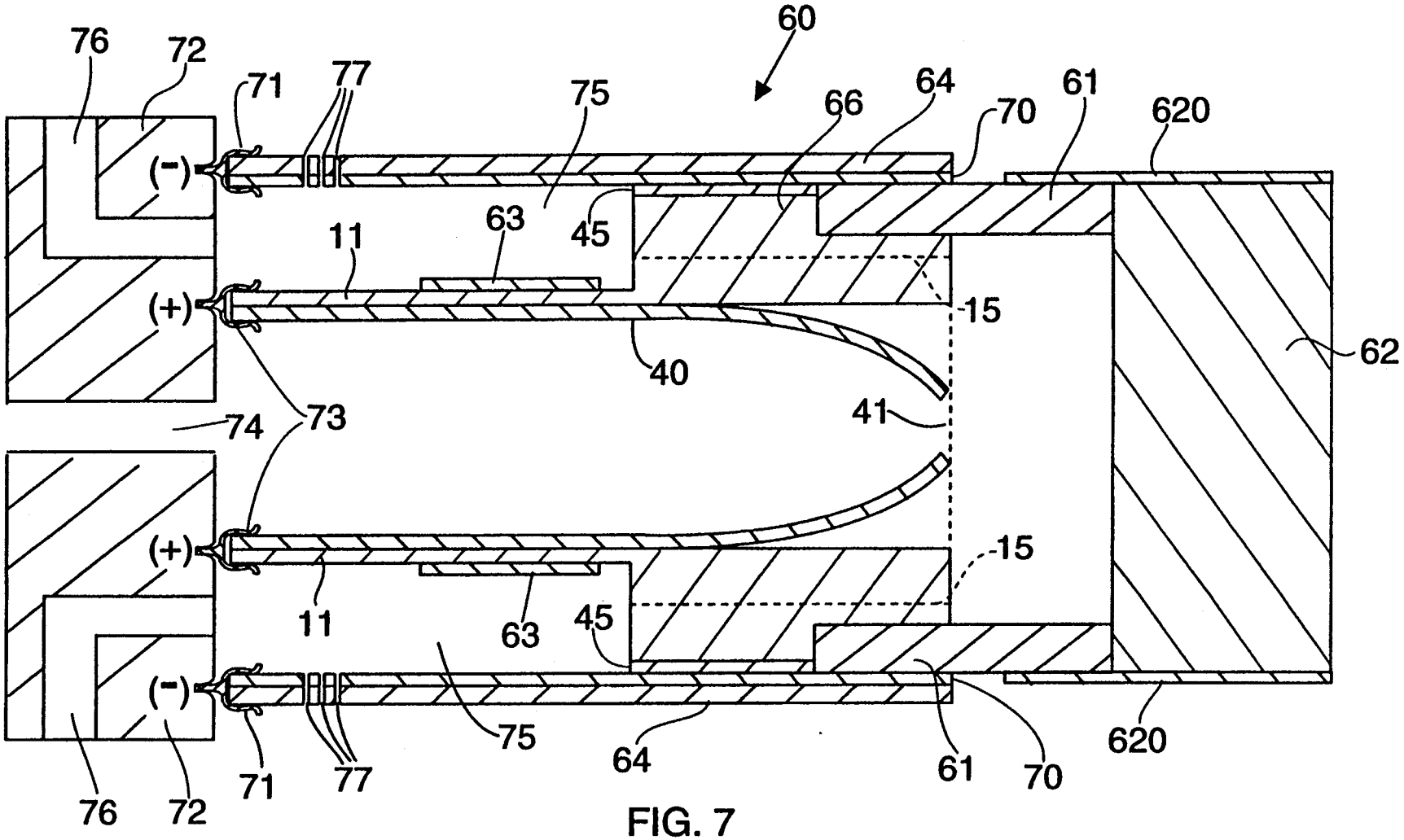
FIG. 7 is a longitudinal cross-sectional view of the tobacco flavor element of FIG. 6, taken from line 7-7 of FIG. 6.

A preferred embodiment of a tobacco flavor element 60 according to the invention is shown in FIGS. 6 and 7. An extension tube 61 fits over extension 13 and is used to mate to heating element 10 a filter 62, which may be made of any suitable filter material, such as cellulose acetate filter material as is commonly used in cigarette filters. Conventional tipping paper 620 may overlay filter 62. Tobacco flavor medium 63, such as that disclosed in said above-incorporated U.S. Pat. No. 5,060,671, is deposited on a central portion of each blade 11.

A protective outer tube 64 is disposed around heating element 10. The inner surface 65 of tube 64 is coated with a conductive material 70, which is in contact with the outer surface of ring 12. Conductive material 70 may be any conductive material that does not evolve undesirable compounds when heated. Material 70 can be in the form of a foil or foil laminate. Preferred materials are selected from the group consisting of gold, aluminum, copper and combinations thereof, and a particularly preferred material is aluminum, provided as part of an aluminum foil and paper laminate from which tube 64 is spiral-wound. If a metal that oxidizes readily, such as aluminum, is used, surface 66 of ring 12 would preferably be provided with sharp points (not shown) which, during assembly, would break through any oxide barrier that may have formed an surface 65, to insure good electrical contact. In any case, surface 66 is itself coated with a conductive material 45, such as gold, to decrease contact resistance.

Connectors 71 on permanent power and control module 72 receive tube 64 and hold it mechanically while electrically connecting it to module 72. Similar connectors 73, one for each blade 11, mechanically and electrically connect blades 11 to module 72. The ends of blades 11 can also be coated with conductive material 45 to decrease contact resistance.

As disclosed in said above-incorporated U.S. Pat. No. 5,060,071, module 72 includes a pressure sensitive switch (not shown) for sensing when a smoking puffs on the electrical smoking article. The interior of reinforcing tube 40, communicating with the smoker's mouth through opening 41, serves as the sensing chamber, which communicates with the switch through bore 74 of module 72. The taper of tube 40 at opening 41 serves to decrease the likelihood of tobacco flavor substance entering the sensing chamber and possibly contaminating the pressure sensitive switch.

When the smoker puffs on the electrical smoking article, causing the heating of tobacco flavor medium 63 and the resulting production of a tobacco flavor aerosol in the void or chamber 75 between blades 11 and outer tube 64, the smoker must be able to draw that aerosol through passages 15. In order for that to occur, air must be able to flow into chamber 75 to replace the air drawn out. This can be accomplished in the embodiment of FIGS. 6 and 7 in at least two ways. First, passages 76 can be provided in module 72 communicating between the outside atmosphere and chamber 75. Second, perforations 77 (additional perforations 77 not shown) can be provided in tube 64 and conductive layer 70.

As discussed above, in order to assure that no undesirable compounds are produced when heating element 10 is actuated, depressions 42 may be provided in those portions of tube 40 underlying areas of blades 11 where the most heating will take place (i.e., where tobacco flavor medium 63 is deposited). This will assure that tube 40 will not char and generate off tastes.

Alternatively, a tobacco flavor material 67 may be applied to the outer surface of tube 40, at least in the areas underlying blades 11, so that any heating of tube 40 that occurs is used to generate additional tobacco flavor aerosol. Such a material may be coated onto the surface of tube 40, or may be applied as an outer layer, such as a layer 67 of reconstituted tobacco sheet.

Figure 8:
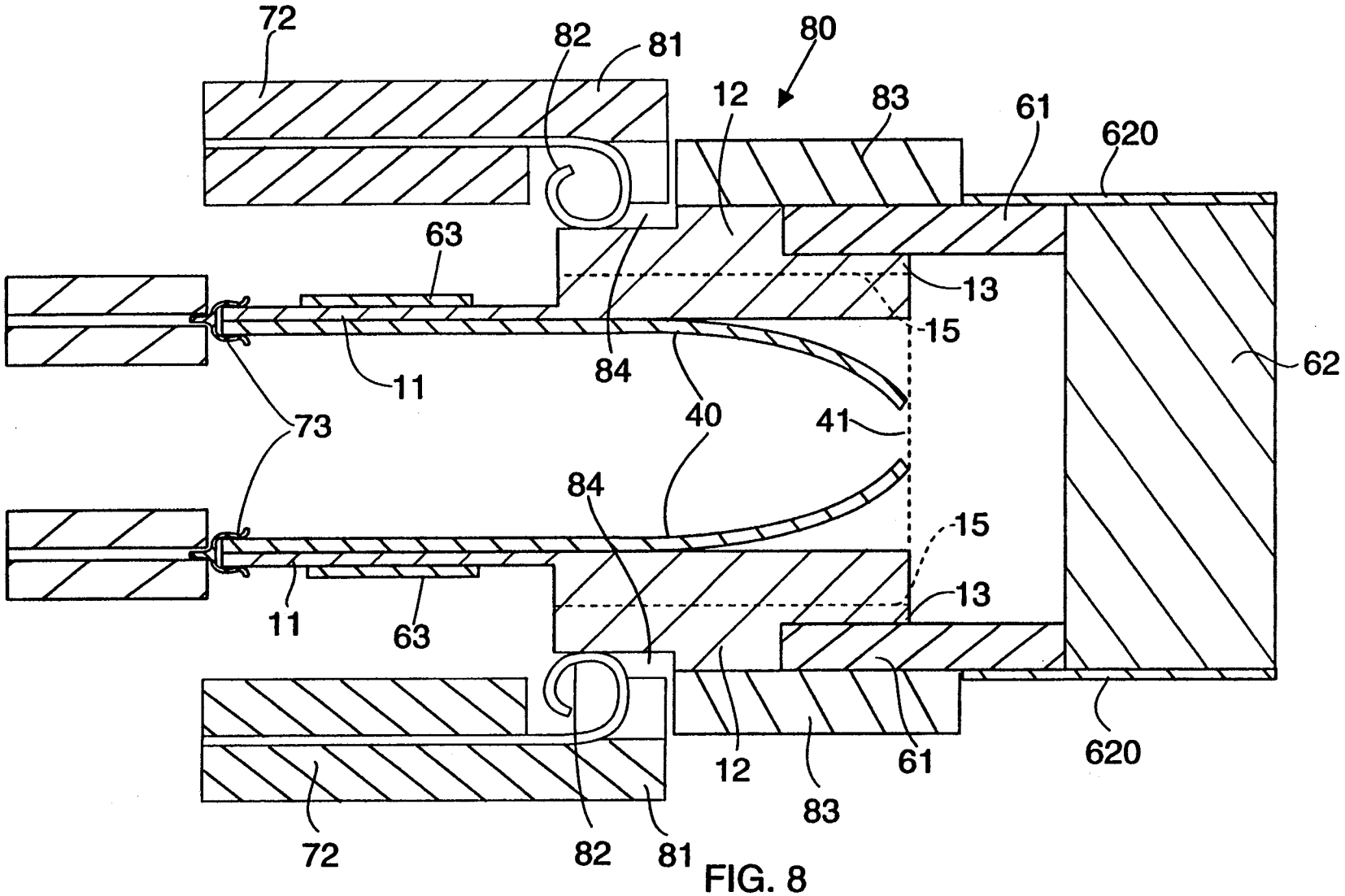
FIG. 8 is a longitudinal cross-sectional view of a second preferred embodiment of a tobacco flavor element according to the present invention, incorporating the heating element of FIGS. 1–5.

Another preferred embodiment of a tobacco flavor generating element 80 according to the present invention is shown in FIG. 8. Tobacco flavor element 80 is similar to element 60, except that tube 64, contact layer 70 and connectors or sockets 71 are omitted. Instead module 72 has socket extension 81 which is lined with contacts 82. A sliding sleeve 83 protects blades 11 and tobacco flavor medium 63 of tobacco flavor element 80 prior to insertion of tobacco flavor element 80 into socket 81. Insertion of element 80 into socket 81 causes sleeve 83 to be pushed back, allowing contacts 82 to contact ring 12. The outer surface of ring 12 in this embodiment is machined down a 84 to provide a stop as well as a conductive surface which again may be coated with conductive layer 70.

Figure 9:
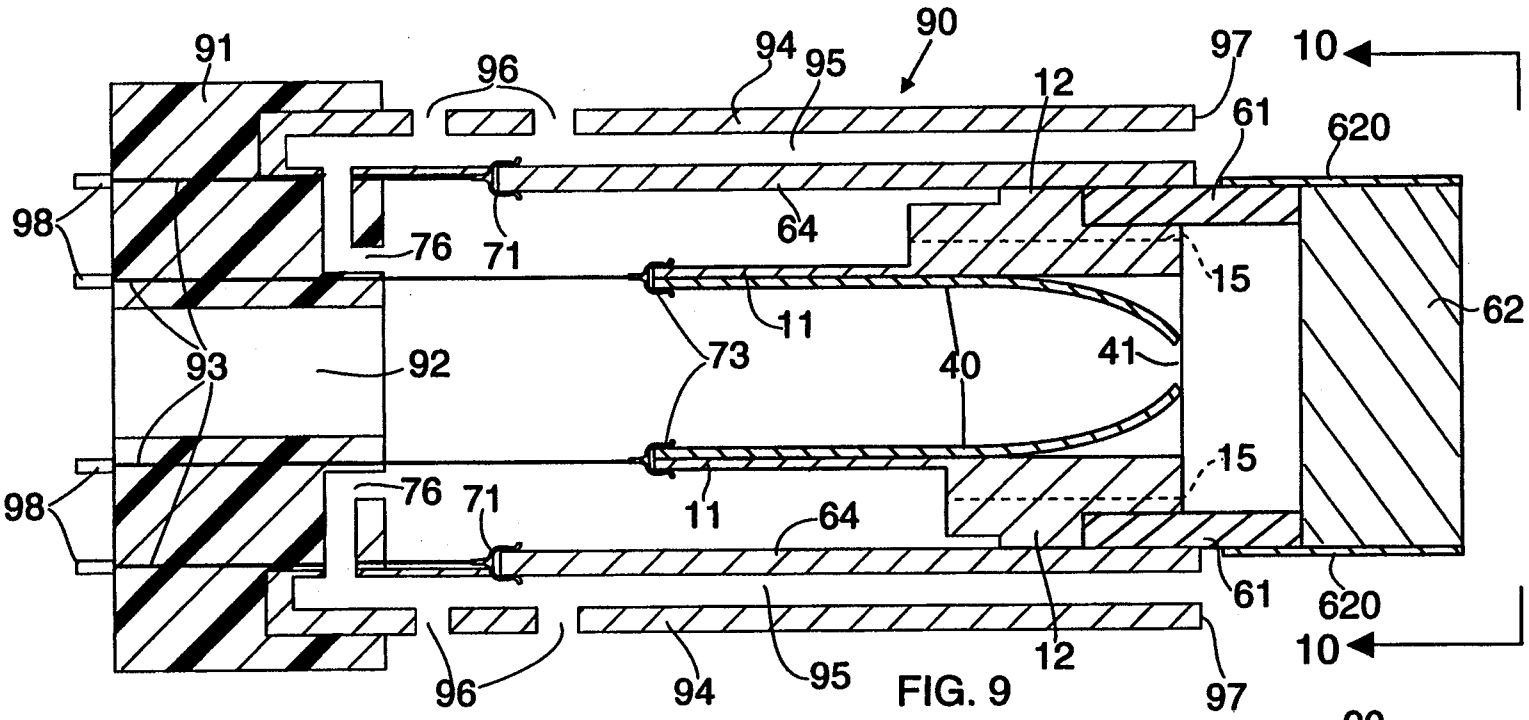
FIG. 9 is a longitudinal cross-sectional view of a third preferred embodiment of a tobacco flavor element according to the present invention, incorporating the heating element of FIGS. 1–5.
Figure 10:
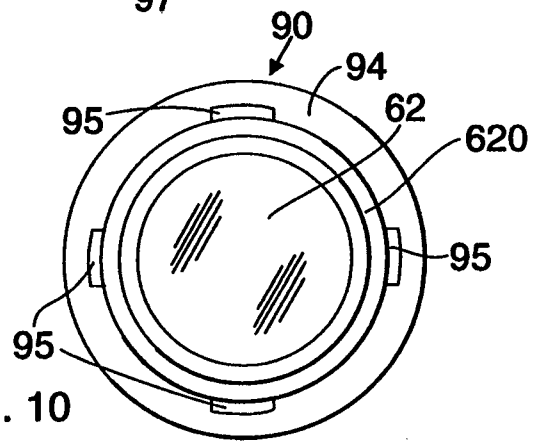
FIG. 10 is a mouth end elevational view of the tobacco flavor element of FIG. 9, taken from line 10—10 of FIG. 9.

A third preferred embodiment of a tobacco flavor element 90 according to the present invention is shown in FIGS. 9 and 10. In this embodiment, which is similar to embodiments 60 and 80, a socket module 91 is interposed between tobacco flavor element 90 and module 72. Module 91 has a bore 92 which is the extension of bore 74, while leads 93 from connectors 71, 73 terminate in plugs 98 that mate with module 72. This embodiment also includes an outer protective tube 94 (e.g., of aluminum) fixed to socket module 91. This arrangement, as illustrated, would block air from entering passages 76. For that reason, grooves 95 on the inner surface of tube 94 overlap passages 76 and allow air to flow out either through perforations 96 in the walls of tube 94, or though the end wall 97 of tube 94. If the latter option is chosen, care must be taken that end 97 is far enough from the mouth end that the smoker's lips will not cover it. Otherwise, grooves 95 will not serve their purpose of allowing outside air into passages 76 when the smoker draws on the article at filter 62, because grooves 95 will also be in the smoker's mouth.

Heating element 10 and tobacco flavor element 60, 80, 90 are relatively inexpensive to produce, being made from the carbon composite material and relatively inexpensive cardboard and aluminum tubes, including reinforcing tube 40 that facilitates the blade heater arrangement. Only small amounts of relatively more expensive metals or other conductive materials are used. Heating element 10 and tobacco flavor element 60, 80, 90 can thus be produced inexpensively enough to be provided as disposable items.

EXAMPLES

Precursor element 50 can be made from a number of variations of the carbon composite material referred to above. Example of some of those variations follow.

EXAMPLE 1

475 grams of carbon were obtained by baking wheat flour in an inert atmosphere at 1000° F. for 12 hours, and then jet milling the resulting material four times to obtain the desired particle size distribution, with an average particle size of about 10 microns. The carbon had a volatiles content of about 15% by weight.

The carbon was blended for approximately 30 minutes in a Sigma blade mixer along with the following additional components:

- 300 grams of phenolic resin (grade SL486A, Borden Chemicals Co., Industrial Resins Division, Louisville, Ky.);
- 25 grams of carbon fiber chopped to 0.25 inch (Panex grade, Stackpole Corporation, Lowell, Mass.);
- 10 grams of methyl cellulose (grade M532, Fisher Scientific, Pittsburgh, Pa.);
- 25 grams of wheat flour; and
- 60 grams of water.

After blending, the mixture was extruded using a laboratory ram extruder into 12-inch long rods having an outer diameter of 10 mm. The rods were collected from the extruder head on U-notched graphite plates for ease of processing. The rods were oven dried in air for three days at 100° F., and then cured in a nitrogen atmosphere for 8 hours at 420° F. After curing of the rods, the graphite plates with the rods were placed in a stainless steel container and continually flushed with argon gas. The container was located in an oven and was baked according to the following cycle:

1. Raise temperature from 420° F. to 1,950° F. in five hours.
2. Hold temperature at 1,950° F. for five hours.
3. Cool to room temperature as fast as argon flushing allows.

The cooled plates and rods were removed from the stainless steel container and the rods were removed from the plates. The rods were ground to the shape illustrated above.

The rods were cut and ground, to form the shape illustrated above, until each blade had a resistance of between about 1.2 Ω and about 1.5 Ω. The blade ends and surface 66 were coated with gold to reduce contact resistance.

EXAMPLE 2

450 grams of carbon were obtained by baking wheat flour in an inert atmosphere at 600° F. for hours, and then jet milling the resulting material four times to obtain the desired particle size distribution, with an average particle size of about microns. The carbon had a volatiles content of about 15% by weight.

The carbon was blended for approximately minutes in a Sigma blade mixer along with the following additional components:

300 grams of phenolic resin (same as above);
50 grams of carbon fiber chopped to 0.25 inch (same as above);
60 grams of methyl cellulose (same as above);
25 grams of wheat flour; and
200 grams of water.

After blending, the mixture was processed as above.

EXAMPLE 3

475 grams of carbon were obtained by baking wheat flour in an inert atmosphere at 1000° F. for 12 hours, and then jet milling the resulting material four times to obtain the desired particle size distribution, with an average particle size of about 10 microns. The carbon had a volatiles content of about 15% by weight.

The carbon was blended for approximately 30 minutes in a Sigma blade mixer along with the following additional components:

300 grams of phenolic resin (same as above);
25 grams of carbon fiber chopped to 0.25 inch (same as above);
20 grams of methyl cellulose (same as above);
25 grams of wheat flour; and
90 grams of water.

After blending, the mixture was processed as above.

EXAMPLE 4

425 grams of carbon were obtained by baking wheat flour in an inert atmosphere at 950° F. for 12 hours, and then jet milling the resulting material four times to obtain the desired particle size distribution, with an average particle size of about 10 microns. The carbon had a volatiles content of about 15% by weight.

The carbon was blended for approximately 30 minutes in a Sigma blade mixer along with the following additional components:

300 grams of phenolic resin (same as above);
75 grams of carbon fiber chopped to 0.25 inch (same as above);
30 grams of methyl cellulose (same as above);
25 grams of wheat flour; and
130 grams of water.

After blending, the mixture was processed as above.

EXAMPLE 5

500 grams of carbon were obtained by baking wheat flour in an inert atmosphere at 1000° F. for 12 hours, and then jet milling the resulting material four times to obtain the desired particle size distribution, with an average particle size of about microns. The carbon had a volatiles content of about 15% y weight.

The carbon was blended for approximately 30 minutes in a Sigma blade mixer along with the following additional components:

400 grams of carbon fiber chopped to 0.25 inch (same as above); and
20 grams of methyl cellulose (same as above).

After blending, the mixture was processed as above.

Thus it is seen that a heating element and a tobacco flavor generating element for an electrical smoking article, using an inexpensive tubular array of heater blades, is provided. One skilled in the art will appreciate that the present invention can be practiced by other than the described embodiments, which are presented for purposes of illustration and not of limitation, and the present invention is limited only by the claims which follow.

What is claimed is:

1. A heating element of an electrical smoking article, said heating element comprising:

a tubular support member;

a tubular array of spaced-apart, electrically conductive blades, said tubular support member received concentrically within said tubular array of blades and being non-unitary with said tubular array of blades;

a tobacco medium located adjacent said tubular array of blades;

said tubular array of blades including an electrically conductive ring portion, each of said blades fixed at one end to said ring portion, each of said blades including a free end remote from said ring portion;

a common electrical connection operative at said ring portion; and a second, electrical connection operative at each of said free ends;

whereby, upon electrical communication of any blade to a power source through said common electrical connection and a respective second electrical connection, said blade becomes electrically heated to produce tobacco flavor from said tobacco flavor medium.

2. The electrical heating element of claim 1, wherein said blades cover a greater portion of said tubular support member than spaces defined between said blades.

3. The electrical heating element of claim 1, wherein said tobacco medium is disposed on said blades.

4. The electrical heating element of claim 1, wherein at least a portion of said tobacco medium is carried by said tubular support member.

5. The heating element of claim 1 wherein said blades comprise a carbon composite material.

6. The heating element of claim 5 wherein said carbon composite material comprises carbon, carbon fibers, and methyl cellulose.

7. The heating element of claim 6 wherein said carbon composite material further comprises flour.

8. The heating element of claim 6 wherein said carbon composite material further comprises phenolic resin.

9. The heating element of claim 6 wherein said carbon composite material further comprises water.

10. The heating element of claim 5 wherein said ring comprises said carbon composite material.

11. The heating element of claim 10 wherein said carbon composite material comprises carbon, carbon fibers, and methyl cellulose.

12. The heating element of claim 11 wherein said carbon composite material further comprises flour.

13. The heating element of claim 11 wherein said carbon composite material further comprises phenolic resin.

14. The heating element of claim 11 wherein said carbon composite material further comprises water.

15. The heating element of claim 1 wherein said ring has an exterior surface coated with a highly conductive material to reduce contact resistance.

16. The heating element of claim 15 wherein said highly conductive material is selected from the group consisting of gold, aluminum, copper, titanium, tantalum, tungsten and combinations thereof.

17. The heating element of claim 16 wherein said highly conductive material is gold.

18. The heating element of claim 1 wherein each said free end has an exterior surface coated with a highly conductive material to reduce contact resistance.

19. The heating element of claim 18 wherein said highly conductive material is selected from the group consisting of gold, aluminum, copper, titanium, tantalum, tungsten and combinations thereof.

20. The heating element of claim 19 wherein said highly conductive material is gold.

21. The heating element of claim 1 wherein an end of said tubular support member is tapered.

22. The heating element of claim 1 wherein said tubular support comprises paperboard.

23. The heating element of claim 22 wherein said paperboard tubular support member has an outer surface, said outer surface having therein angularly-spaced longitudinal depressions corresponding to locations of said blades.

24. The heating element of claim 22 wherein said paperboard tubular support member is spiral-wound.

25. A tobacco flavor element for an electrical smoking article, said tobacco flavor element comprising:

a heating element, including:

an electrical conductive ring having a circumference and a central axis, a tubular array of spaced apart electrically conductive blades, said blades attached to said ring and extending in a direction parallel to said central axis and defining together a blade portion circumference, each of said blades having a free end remote from said ring, said ring circumference exceeding said blade portion circumference, said ring defining a common electrical contact operative with all of said blades, and a tubular support disposed concentrically within said tubular array of blades, said tubular support supporting said blades;

a mouthpiece tube disposed concentrically about said heating element, said mouthpiece tube having inner and outer surfaces, at least a portion of said inner surface being electrically conductive and electrically contacting said ring, said mouthpiece tube and said tubular array of blades being spaced apart so as to define a fluid flow passage therebetween;

an electrical socket, said electrical socket comprising:

a first electrical connector electrically connecting said socket with said electrically conductive portion of said inner surface of said mouthpiece tube, a plurality of second electrical connectors electrically connecting said socket to each of said free ends of said blades, and main connector means for connecting said first and second electrical connectors to a power and control module of an electrical smoking article;

means for communicating said fluid flow passage with an external atmosphere; and a tobacco flavor medium disposed on said blades.

26. The tobacco flavor element of claim 25 wherein said blades comprise a carbon composite material.

27. The tobacco flavor element of claim 26 wherein said carbon composite material comprises carbon, carbon fibers, and methyl cellulose.

28. The tobacco flavor element of claim 27 wherein said carbon composite material further comprises flour.

29. The tobacco flavor element of claim 27 wherein said carbon composite material further 30. The tobacco flavor element of claim 28 wherein said carbon composite material further comprises water.

31. The tobacco flavor element of claim 26 wherein said ring comprises said carbon composite material.

32. The tobacco flavor element of claim 31 wherein said carbon composite material comprises carbon, carbon fibers, and methyl cellulose.

33. The tobacco flavor element of claim 32 wherein said carbon composite material further comprises flour.

34. The tobacco flavor element of claim 32 wherein said carbon composite material further comprises phenolic resin.

35. The tobacco flavor element of claim 32 wherein said carbon composite material further comprises water.

36. The tobacco flavor element of claim 25, wherein said means for communicating comprises openings in said mouthpiece tube.

37. The tobacco flavor element of claim 25, wherein said means for communicating comprises channels in said socket, said channels communicating said fluid flow passage with the atmosphere.

38. The tobacco flavor element of claim 25 further comprising an outer protective tube concentrically disposed about said mouthpiece tube, said outer protective tube having passageways communicating said fluid flow passageway with the atmosphere.

39. The tobacco flavor element of claim 38 wherein: said passageways pass through said outer protective tube.

40. The tobacco flavor element of claim 38 wherein: said outer protective tube has an inner surface; and said passageways comprise longitudinal grooves along said inner surface of said outer protective tube, said longitudinal grooves in registration with said communication means.

41. The tobacco flavor element of claim 25 wherein said ring has an exterior surface coated with a highly conductive material to reduce contact resistance.

42. The tobacco flavor element of claim 41 wherein said highly conductive material is selected from the group consisting of gold, aluminum, copper, titanium, tantalum, tungsten and combinations thereof.

43. The tobacco flavor element of claim 42 wherein said highly conductive material is gold.

44. The tobacco flavor element of claim 25 wherein each said free end has an exterior surface coated with a highly conductive material to reduce contact resistance.

45. The tobacco flavor element of claim 44 wherein said highly conductive material is selected from the group consisting of gold, aluminum, copper, titanium, tantalum, tungsten and combinations thereof.

46. The tobacco flavor element of claim 45 wherein said highly conductive material is gold.

47. The tobacco flavor element of claim 25 wherein said conductive portion of said inner surface of said mouthpiece tube comprises a metallic layer.

48. The tobacco flavor element of claim 47 wherein said metallic layer comprises a highly conductive material selected from the group consisting of gold, aluminum, copper, titanium, tantalum, tungsten and combinations thereof.

49. The tobacco flavor element of claim 47 wherein said metallic layer comprises a metallic foil.

50. The tobacco flavor element of claim 49 wherein said metallic layer comprises aluminum.

51. The tobacco flavor element of claim 25 wherein said ring has openings for allowing communication between a fluid flow passage and said mouth end of said tobacco flavor element.

52. The tobacco flavor element of claim 25 wherein said support has an outer surface, and a tobacco flavor material disposed on said outer surface.

53. The tobacco flavor element of claim 52 wherein said tobacco flavor material is formed as a sheet, said sheet forming said outer surface.

54. The tobacco flavor element of claim 53 wherein said sheet contains tobacco.

55. The tobacco flavor element of claim 54 wherein said sheet is reconstituted tobacco sheet.

56. The tobacco flavor element of claim 25 wherein said support comprises a substantially non-combustible tube.

57. The tobacco flavor element of claim 56 wherein an end of said substantially non-combustible tube is tapered.

58. The tobacco flavor element of claim 56 wherein said substantially non-combustible tube comprises paperboard.

59. The tobacco flavor element of claim 58 wherein said paperboard tube has an outer surface, said outer surface having therein angularly-spaced longitudinal depressions corresponding to locations of said blade.

60. The tobacco flavor element of claim 58 wherein said paperboard tube is spiral wound.

61. The tobacco flavor element of claim 25 further comprising a filter plug at a mouth end of said mouthpiece tube.

62. The tobacco flavor element of claim 61 wherein said free end of each of said blades is is distal from said mouth end and said ring is proximal to said mouth end.

* * * * *